US006419015B1

(12) United States Patent
Budde et al.

(10) Patent No.: US 6,419,015 B1
(45) Date of Patent: Jul. 16, 2002

(54) APPARATUS AND A METHOD FOR LAUNCHING PLUGS

(75) Inventors: Peter Budde, Vlaardingen; Guus Veersteeg, Poortugal, both of (NL)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/529,310

(22) PCT Filed: Oct. 9, 1998

(86) PCT No.: PCT/GB98/03058

§ 371 (c)(1),
(2), (4) Date: Jun. 23, 2000

(87) PCT Pub. No.: WO99/19601

PCT Pub. Date: Apr. 22, 1999

(30) Foreign Application Priority Data

Oct. 11, 1997 (GB) ..... 9721537

(51) Int. Cl.[7] ..... E21B 33/13

(52) U.S. Cl. ..... 166/291; 166/386; 166/75.15; 166/70; 166/177.4

(58) Field of Search ..... 166/291, 386, 166/75.15, 192, 177.4, 177.3, 70

(56) References Cited

U.S. PATENT DOCUMENTS 3,444,928 A * 5/1969 Pitts
4,782,894 A * 11/1988 LaFleur ..... 166/70
5,443,122 A * 8/1995 Brisco ..... 166/285
5,950,725 A * 9/1999 Rondeau et al. ..... 166/70
6,009,944 A * 1/2000 Gudmestad ..... 166/192

* cited by examiner

*Primary Examiner*—William Neuder
(74) *Attorney, Agent, or Firm*—Moser, Patterson & Sheridan, L.L.P.

(57) ABSTRACT

The invention relates to an apparatus and a method for launching plugs used in the construction of an oil or of gas well. There is provided an apparatus for launching a plug, said apparatus comprising a canister (4) connectable to a running string, a plug (6, 16) retained in said canister, and a tube (9, 13) having a bursting disk (37, 38), the arrangement being such that, in use, an increase in fluid pressure in said tube ruptures said bursting disk allowing an increase in fluid pressure above said plug to launch said plug. The apparatus is particularly suited to launching two, three or more plugs independently. There is also provided a method of launching a plug from a canister, which method comprises the steps of blocking a tube; increasing pressure in said tube above said blockage to a predetermined pressure at which a bursting disk in said tube ruptures allowing fluid pressure to increase above said plug and launches said plug.

33 Claims, 2 Drawing Sheets

APPARATUS AND A METHOD FOR LAUNCHING PLUGS

BACKGROUND OF THE INVENTION

Field of the Invention

This invention relates to an apparatus and a method for launching plugs used in the construction of an oil or gas well.

In the construction of an oil or gas well, a hole is drilled in the ground. A casing string is then lowered into the ground and hung from the surface. The casing string is then cemented into the wellbore. The cement is pumped down through the casing string and forced out of the bottom of the casing string through a float shoe and a float collar and up the annulus formed between the external surface of the casing string and the internal wall of the wellbore. A first plug is usually launched from the top of the string ahead of the cement. A second plug is usually launched after the cement to act, amongst other things, as a barrier between the cement and the fluid being used to force the cement down the casing, and also to wipe clean the inside of the casing.

In the preparation of certain wells, a hole is drilled through the ground below a casing string. A liner of smaller diameter than the casing is then lowered through the casing and hung from the bottom end of the casing string. The liner is then cemented into the wellbore. The cement is pumped down through the liner and forced out of the bottom of the liner through a float shoe and float collar and up the annulus formed below the external surface of the liner and the internal wall of the wellbore or of the internal surface of the casing. A first plug is usually launched from the top of the liner ahead of the cement. At second plug is usually launched after the cement to act, amongst other things, as a barrier between the cement and the fluid being used to force the cement down the liner and also to wipe clean the inside of the casing.

One of the problems of existing apparatus is ensuring that plugs are launched reliably.

A bursting disk is disclosed in FIG. 27 of Applicants' PCT Publication No. WO 96/34175. However, this is used to facilitate the separation of two plugs which may have been accidentally launched together.

The invention attempts to solve this problem.

Accordingly there is provided an apparatus for launching a plug, the apparatus comprising a canister connectable to a running string, a plug retained in. said canister, and a tube having a bursting disk, the arrangement being such that, in use, an increase in fluid pressure in said tube ruptures said bursting disk allowing an increase in fluid pressure above said plug to launch said plug.

Preferably, the apparatus further comprises a landing seat in said tube arranged below said bursting disk, the arrangement being such that, in use, when a dart lands on said landing seat, pressure is increased above said dart to rupture said bursting disk allowing an increase in fluid pressure above said plug to launch said plug.

Advantageously, the tube has an upper and a lower end, said lower end being attached to said plug and said upper end being slidably arranged with respect to a second tube.

Preferably, there is a sealing ring arranged between said tube and said second tube.

Advantageously, there is provided a further bursting disk in said tube arranged below said landing seat. The further bursting disk is designed to burst at a higher pressure than the bursting disk. The further bursting disk ruptures after the plug lands on a float collar, float shoe or other obstacle in the casing or liner and after a considerable pressure has been applied. This would then allow cement to flow through the plug and into the annulus between the casing or liner and the wellbore or casing.

Preferably, said tube has a portion which extends from said landing seat to retain said dart.

Advantageously, at least one port is provided in said canister above said plug. The port aids smooth ejection of the plug.

Preferably, said tube is substantially concentric with said plug and there is provided an annulus therebetween. The annulus should not be continuous along the length of the plug.

If so desired the apparatus may comprise a second plug which is attached to said second tube, said second tube having a second bursting disk and being slidable with respect to a third tube.

Advantageously, the apparatus further comprises a second landing seat in said second tube arranged below said second bursting disk, the arrangement being such that, in use, when a second dart lands on said second landing seat, pressure is increased above said second dart to rupture said second bursting disk allowing an increase in fluid pressure above said second plug to launch said second plug.

Preferably, a sealing ring is arranged between said second tube and said third tube.

Advantageously, there is provided a further bursting disk in said second tube arranged below said second landing seat.

Preferably, at least one port is provided in said canister above said second plug. The ports may be placed between the plugs to aid separation thereof.

Advantageously, said second tube has a portion which extends from said second landing seat to retain said second dart.

Preferably, said second tube is substantially concentric with said second plug and there is provided an annulus therebetween.

If so desired the apparatus further comprises a third plug which is attached to said third tube, said third tube having a third bursting disk and which third tube is slidable with respect to a fourth tube.

Advantageously, the apparatus further comprises a third landing seat in said third tube arranged below said third bursting disk, the arrangement being such that, in use, when a third dart lands on said third landing seat, pressure is increased above said third dart to rupture said third bursting disk allowing an increase in fluid pressure above said third plug to launch said third plug.

Preferably, a sealing ring arranged between said third tube and said fourth tube.

Advantageously, there is provided a further bursting disk in said tube arranged below said third landing seat.

Preferably, least one port is provided in said canister above said third plug.

Advantageously, said third tube has a portion which extends from said third landing seat to retain said third dart.

Preferably, said third tube is substantially concentric with said third plug and there is provided, an annulus therebetween.

Advantageously, said second tube is shear pinned to said third tube in a two plug arrangement.

Preferably, said third tube is shear pinned to said fourth tube in a three plug arrangement.

Advantageously, said canister comprises at least one retaining rib for each of said plugs.

Preferably, each of said plugs comprises fins and wherein said canister comprises at least one retaining rib for each of said fins.

There is also provided a method of launching a plug from a canister, which method comprises the steps of blocking a tube; increasing pressure in said tube above said blockage to a predetermined pressure at which a bursting disk in said tithe ruptures allowing fluid pressure to increase above said plug and launches said plug.

In a two or more plug arrangement the method comprises the further step of increasing pressure between said plug and second plug launching said plug.

In a three or more plug arrangement the method comprises the further step of increasing pressure between said second plug and third plug launching said second plug.

BRIEF DESCRIPTION OF THE DRAWINGS

For a better understanding of the invention reference will now be made, by way of example, to the accompanying drawing which shows a longitudinal cross-sectional view of an apparatus in accordance with the present invention.

Referring to the drawing there is shown a plug launching apparatus which is generally designated by reference number 1 in a section of a casing string 2. The plug launching apparatus 1 is connected to a running string (not shown) by an adaptor 3.

Figure 1A:
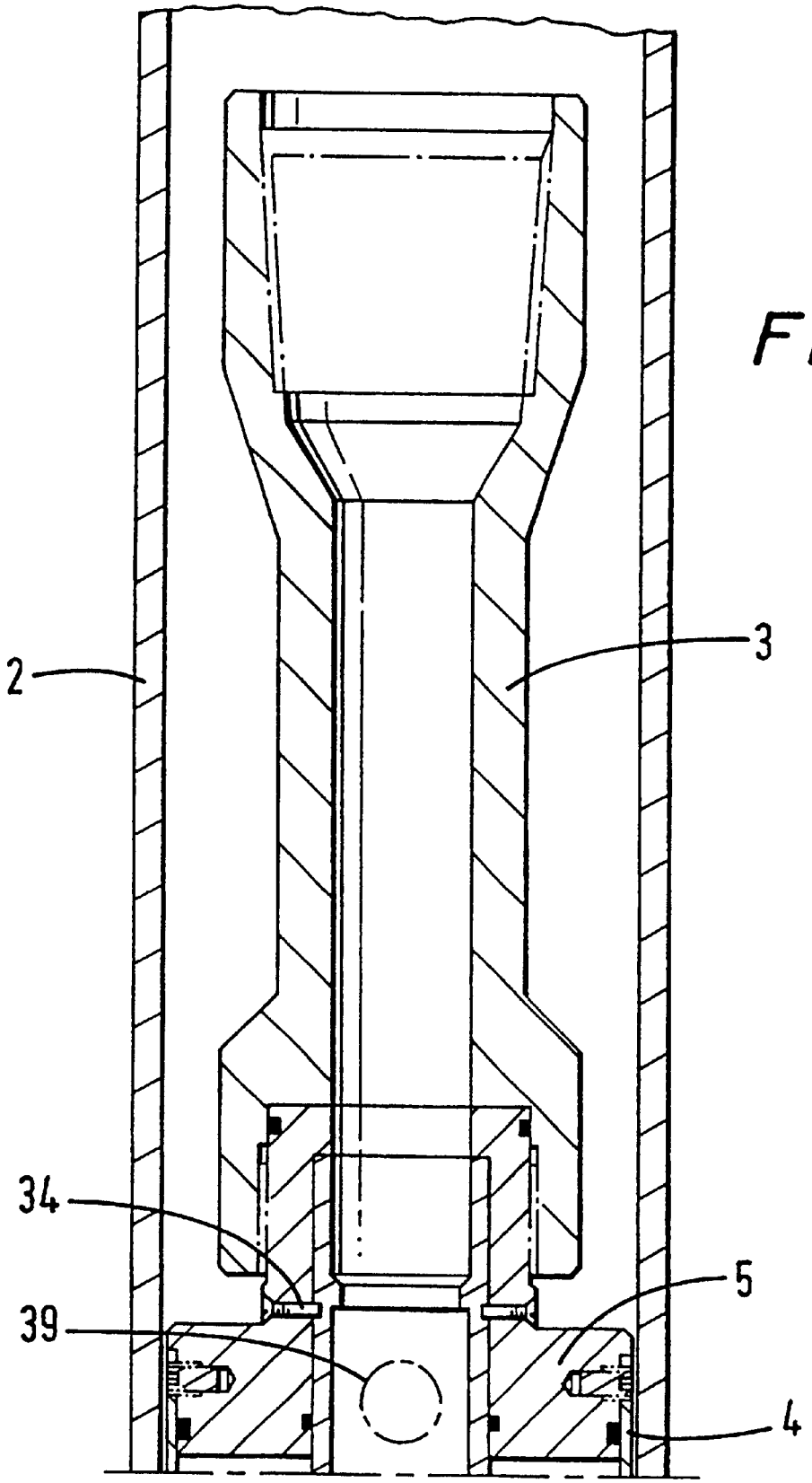
Figure 1B:
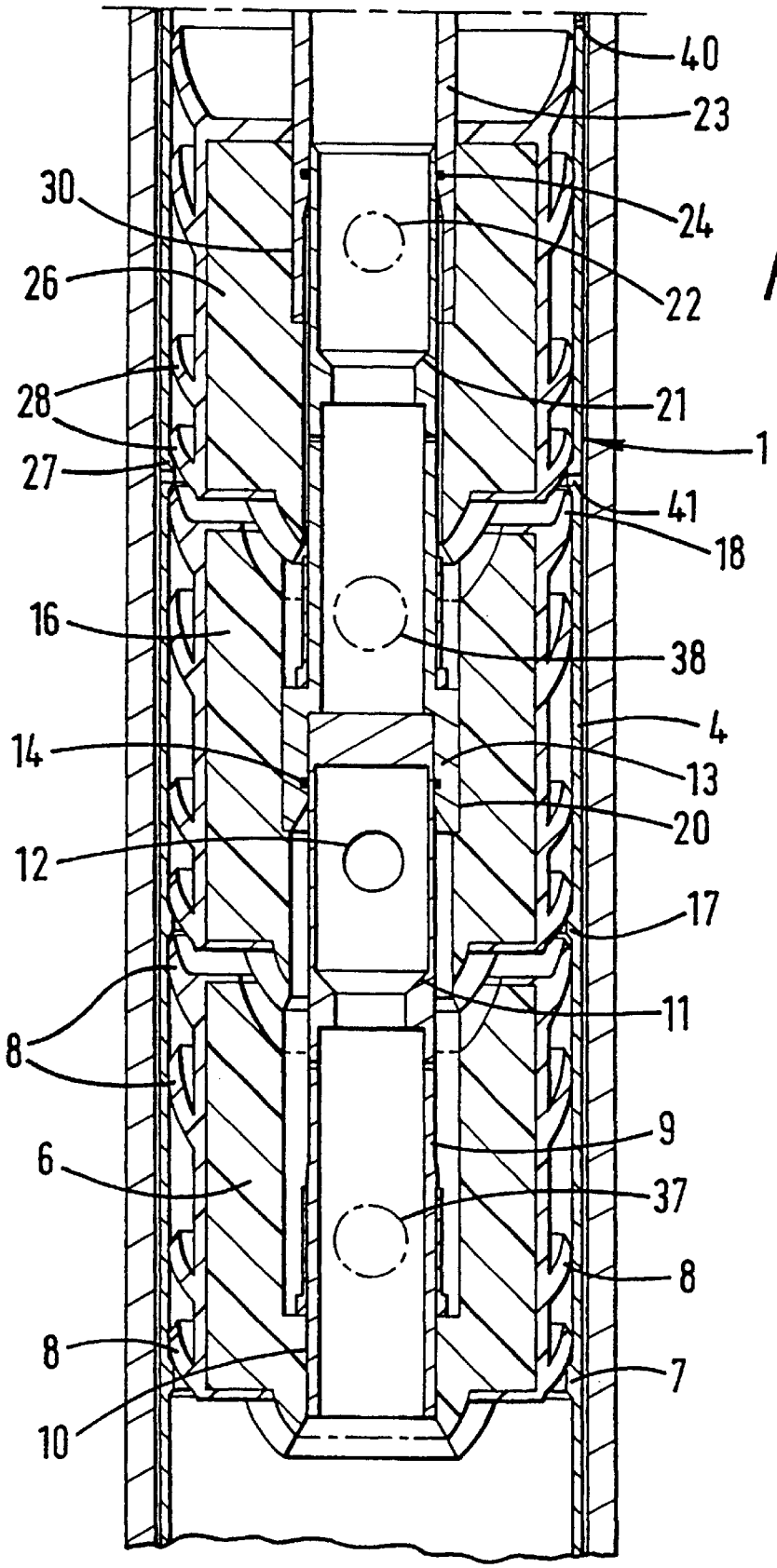

The apparatus 1 comprises a canister 4 having a cylindrical portion and a hub 5.

DETAILED DESCRIPTION OF THE PREFERRED EMBODIMENT

A first plug 6 having four fins 8 is retained in the canister 4 by an internal rib 7. Only one rib 7 is shown, however, it is envisaged that ribs will be placed below each fin 8. The first plug 6 is provided with a substantially concentric first tube 9 which is glued or otherwise attached to the bottom 10 of the first plug 6. An annulus is provided between the first tube 9 and the first plug 6 above the bottom 10. The first tube 9 is provided with a first dart landing seat 11 above which is located a bursting disk 12 in the first tube 9. The top of the first tube 9 is slidably arranged in a second tube 13. A sealing ring 14 is provided between the first tube 9 and the second tube 13. An annulus is provided around the first bursting disk 12 and a second plug 16.

In use, a first dart (not shown) is pumped down the running string. The first dart will land on the first dart landing seat 11. Pressure is raised in the running string above the first dart to a first predetermined pressure, at which the first bursting disk 12 ruptures allowing a pressure increase above the first plug 6 and below a second plug 16, the plug 6 launches taking with it the first tithe 1 and the first dart (not shown) which is at least at least partly retained in said first tube 9. It should be noted that before the at least one first bursting disk 12 ruptures, there is an area across the first dart subjected to raised pressure, however the resultant force is not great enough to launch the first plug.

The second plug 16 is retained in the canister by a rib 17. Only one rib 17 is shown, however, it is envisaged that ribs will be placed below each fin 18. The second plug 16 is provided with a substantially concentric second tube 13 which is glued or otherwise attached to the middle 20 of the second plug 16. An annulus is provided between the second tube 13 and the second plug 16 above and below the middle 20. The second tithe 13 is provided with a second dart landing seat 21, which has a larger opening than that of the first dart landing seat 11. Above the second landing seat 21 there is located at least one second bursting disk 22 in the second tube 13. The top of the second tube 13 is slidably arranged in a third tube 13. A sealing ring 24 is provided between the second tube 13 and the third tube 23. An annulus is provided around the second bursting disk 22 and the third plug 26.

In use, a second dart (not shown), the nose of which would be of larger diameter than the first dart, is pumped down the running string. The second dart will land on the second dart landing seat 21. Pressure is raised in the running string above the second dart to a second predetermined pressure, greater than the first predetermined pressure, at which the second bursting disk 22 ruptures allowing a pressure increase above the second plug 16 and below the third plug 26. The second plug 16 launches, taking with it the second tube 13 and the second dart (not shown) which is retained in said second tube 13. It should be noted that before the at least one second bursting disk 22 ruptures, there is an area across the second dart subjected to raised pressure, however the resultant force is not great enough to launch the second plug.

The third plug 26 is retained in the canister by a rib 27. Only one rib is shown, however, it is envisaged that ribs will be placed below each fin 28. The third plug 26 is provided with a substantially concentric third tube 23 which is glued or otherwise attached to the top 30 of the third plug 26. An annulus is provided between the third tithe 23 and the third plug 26 below the top 30. The third plug is provided with a third dart landing seat 31, which has a larger opening than that of the second dart landing seat 21. Above third dart launching seat 31 there is located at least one third bursting disk in the third tube 23. The top of the third tube 23 is shear pinned to hub 5 by at least one shear pin 34.

In use, a third dart (not shown), the nose of which would be of greater diameter than the second dart, is pumped down the running string. The third dart will land on the third dart landing seat 31. Pressure is raised in the running string above the third dart to a predetermined pressure, at which at least one shear pin 34 shears. The plug 26 launches, taking with it the third tithe 23 and the third dart (not shown) which is at least partly retained in third tube 23.

Further bursting disks 37, 38, 39 are provided in the first, second and third tubes 9, 13, 23 so that at predetermined pressures, the further bursting disks can rupture and fluid may pass through the first, second and third plugs 6, 16, 26 after launching and landing thereof.

Small holes 40 and 41 in the canister 4 act as dampeners allowing a slow pressure equalisation and aid smooth release of each plug 6, 16, 26 independently.

It should be noted that the clearance between the casing string 1 and the canister 4 may be as small, as possible.

The above described apparatus could be modified to launch four or more plugs independently of one another as well as one, two or three.

Various modifications to the embodiment described are envisaged, for example the ribs could be dispensed with, reliance being placed on the radial force between the plugs and the canister. However, this is not recommended since it is much preferred to very firmly retain the plugs in the canister and to rely on substantially hydraulic pressure to eject the plugs.

What is claimed is:

1. An apparatus for launching a plug, comprising:

a canister connected to a running string;

a plug retained in the canister and;

a tube disposed within the plug wherein the tube further comprises a landing seat to receive a dart and a bursting disk disposed in the tube above the landing seat such that when said bursting disk ruptures fluid pressure within the drill string is then applied to the top of the plug to launch the plug.

2. An apparatus for launching a plug according to claim 1 further comprising a further bursting disk disposed within the tube below the landing seat.

3. An apparatus for launching a plug according to claim 2 wherein the rupture disk and the further rupture disk are disposed in a sidewall of the tube.

4. An apparatus for launching a plug according to claim 2 wherein the further rupture disk ruptures at a higher pressure than the rupture disk.

5. An apparatus for launching a plug according to claim 1 wherein the tube is substantially concentric within the plug.

6. An apparatus for launching a plug according to claim 1 wherein the plug further comprises a fin and the canister further comprises a rib wherein the rib is positioned beneath the fin so as to retain the plug within the canister.

7. An apparatus for launching a plug, comprising:

a canister connected to a running string;

a first plug retained in the canister and;

a first tube disposed within the plug, the first tube further comprising a first landing seat and a first bursting disk disposed in a wall of the first tube above the first landing seat;

a second plug retained in the canister above the first plug and;

a second tube disposed within the second plug, the second tube further comprising a second landing seat and a second bursting disk disposed in a wall of the second tube above the second landing seat wherein;

when said first bursting disk ruptures fluid pressure is ported between the first plug and the second plug to launch the first plug; and when said second bursting disk ruptures fluid pressure within the drill string is applied to the top of the second plug to launch the second plug.

8. An apparatus for launching a plug according to claim 7 wherein the first tube is slidably arranged within the second tube.

9. An apparatus for launching a plug according to claim 7 further comprising a sealing ring provided between the first tube and the second tube.

10. An apparatus for launching a plug according to claim 7 wherein the first tube is substantially concentric within the first plug and the second tube is substantially concentric within the second plug.

11. An apparatus for launching a plug according to claim 7 wherein the second landing seat has a larger opening than said first landing seat.

12. An apparatus for launching a plug according to claim 8 further comprising a first further bursting disk disposed within the first tube below the first landing seat and a second further bursting disk disposed within the second tube below the second landing seat.

13. An apparatus for launching a plug according to claim 12 wherein the first further bursting disk ruptures at a pressure greater than the pressure to rupture the first bursting disk and less than the pressure to rupture the second bursting disk and the second further bursting disk.

14. An apparatus for launching a plug according to claim 13 wherein the second further bursting disk ruptures at a pressure greater than the pressure to rupture the second bursting disk.

15. An apparatus for launching a plug according to claim 13 further comprising:

a third plug retained in the canister above the second plug and;

a third tube disposed within the third plug, the third tube further comprising a third landing seat and a third bursting disk disposed in a wall of the third tube above the third landing seat wherein; and when said third bursting disk ruptures fluid pressure within the running string is ported on top of the third plug to launch the third plug.

16. An apparatus for launching a plug according to claim 15 wherein the second tube is slidably arranged within the third tube.

17. An apparatus for launching a plug according to claim 15 further comprising a sealing ring between the second tube and the third tube.

18. An apparatus for launching a plug according to claim 15 wherein the third tube is substantially concentric within the third plug.

19. An apparatus for launching a plug according to claim 15 wherein the third landing seat has a larger opening than the second landing seat.

20. An apparatus for launching a plug according to claim 15 further comprising a third further bursting disk disposed within the third tube below the third landing seat.

21. An apparatus for launching a plug according to claim 15 wherein the third further bursting disk ruptures at a pressure greater than the pressure to rupture the third bursting disk.

22. A method of launching a plug from a canister comprising the steps of:

disposing a plug within a canister;

disposing a tube within the plug;

blocking the tube;

increasing the pressure in the tube above the blockage to a predetermined pressure;

rupturing a bursting disk within the tube; and launching the plug by applying fluid pressure to the top of the plug.

23. A method according to claim 22 further comprising the steps of:

retaining a second plug within the canister and above the first plug; and launching the second plug by increasing the pressure between the plug and the second plug.

24. A method according to claim 23 further comprising the steps of:

retaining a third plug within the canister and above the second plug; and launching the third plug by increasing the pressure between the second plug and the third plug.

25. A method of launching a plug, comprising:

pumping a dart down a drilling string and into a canister;

landing the dart on a landing seat in a tube disposed within a plug;

increasing the pressure within the drilling string to rupture a first bursting disk above the plug; and launching the plug by porting drill string pressure to the top of the plug.

26. A method of launching a plug according to claim 25 further comprising:

landing the plug on an obstacle;

increasing the pressure within the drill string to rupture a further burst disk; and flowing cement through the plug.

27. A method of launching two plugs in a wellbore, comprising:

pumping a first dart down a drilling string and into a canister;

landing the first dart on a landing seat in a first tube disposed in a first plug and within the canister;

increasing the pressure within the drill string to rupture a bursting disk in the first tube;

launching the first plug by porting drill string fluid pressure to the top of the first plug;

landing a second dart on a landing seat in a second tube disposed in a second plug and within the canister;

increasing the pressure within the drill string to rupture a bursting disk in the second tube; and launching the second plug by porting drill string fluid pressure to the top of the second plug.

28. A method of launching two plugs in a wellbore according to claim 27 further comprising the steps of:

landing the first plug within the wellbore;

rupturing a further bursting disk within the first tube; and pumping fluid through the first plug.

29. A method of launching two plugs in a wellbore according to claim 28 further comprising the steps of:

landing the second plug within the wellbore;

rupturing a further bursting disk within the second tube; and pumping fluid through the second plug.

30. A method for launching three plugs, comprising:

disposing a first tube within a first plug;

disposing a second tube within a second plug;

disposing a third tube within a third plug;

slidably arranging the first tube within the second tube and the second tube within the third tube;

retaining the first plug, the second plug and the third plug within a canister in a wellbore;

landing a first dart in the first tube;

increasing the pressure applied within the first tube to rupture a bursting disk within the first tube;

launching the first plug by applying pressure to the top of the first plug; landing a second dart in the second tube;

increasing the pressure applied within the second tube to rupture a bursting disk within the second tube;

launching the second plug by applying pressure to the top of the second plug;

landing a third dart in the third tube;

increasing the pressure applied within the third tube to rupture a bursting disk within the third tube; and launching the third plug by applying pressure to the top of the third plug.

31. A method for launching three plugs according to claim 30 wherein fluid is pumped through the first plug comprising:

landing the first plug within a wellbore;

increasing the pressure applied to the first tube to rupture a further bursting disk in the first tube; and pumping a fluid through the first plug and further bursting disk.

32. A method for launching three plugs according to claim 30 wherein fluid is pumped through the second plug comprising:

landing the second plug within a wellbore;

increasing the pressure applied to the second tube to rupture a further bursting disk in the second tube; and pumping a fluid through the second plug and further bursting disk.

33. A method for launching three plugs according to claim 30 wherein fluid is pumped through the third plug comprising:

landing the third plug within a wellbore;

increasing the pressure applied to the third tube to rupture a further bursting disk in the third tube; and pumping a fluid through the third plug and further bursting disk.

* * * * *